US012690631B2

(12) United States Patent
Hoover

(10) Patent No.: US 12,690,631 B2
(45) Date of Patent: Jul. 28, 2026

(54) PROTECTIVE BODY GEAR DEVICE

(71) Applicant: Patrick Hoover, Las Vegas, NV (US)

(72) Inventor: Patrick Hoover, Las Vegas, NV (US)

( * ) Notice: Subject to any disclaimer, the term of this patent is extended or adjusted under 35 U.S.C. 154(b) by 0 days.

(21) Appl. No.: 18/896,092

(22) Filed: Sep. 25, 2024

(65) Prior Publication Data

US 2026/0083185 A1 Mar. 26, 2026

(51) Int. Cl.

| | |
|---|---|
| ***A41D 13/00*** | (2006.01) |
| ***A41D 13/05*** | (2006.01) |
| ***A41D 13/08*** | (2006.01) |
| ***A41D 31/08*** | (2019.01) |
| ***A41D 31/28*** | (2019.01) |

(52) U.S. Cl.

CPC ..... *A41D 13/0002* (2013.01); *A41D 13/0562* (2013.01); *A41D 13/08* (2013.01); *A41D 31/08* (2019.02); *A41D 31/28* (2019.02)

(58) Field of Classification Search

CPC ..... A41D 13/0002; A41D 13/0005; A41D 13/0543; A41D 13/0562; A41D 13/0568; A41D 13/06; A41D 13/065; A41D 13/08; A41D 31/08; A41D 31/28; A41D 31/085; A63B 2071/1258

USPC ..... 2/455, 1, 16, 22

See application file for complete search history.

(56) References Cited

U.S. PATENT DOCUMENTS

| | | | | |
|---|---|---|---|---|
| 5,373,584 | A * | 12/1994 | Parcells, III | A41D 13/0153 2/24 |
| 5,456,658 | A * | 10/1995 | Duback | A41D 13/065 2/24 |
| 5,943,695 | A * | 8/1999 | Yen | A63B 71/1225 2/22 |
| 7,725,951 | B2 * | 6/2010 | Rampersad | A41D 13/065 2/24 |
| 10,602,791 | B2 * | 3/2020 | Jur | A41D 13/02 |
| 2006/0137071 | A1 * | 6/2006 | Rampersad | A41D 13/0556 2/24 |
| 2013/0061377 | A1 * | 3/2013 | Wyner | B32B 5/245 2/455 |
| 2022/0395035 | A1 * | 12/2022 | Leone | A41D 13/08 |

* cited by examiner

*Primary Examiner* — Jameson D Collier

(57) ABSTRACT

A protective body gear device includes a panel, a shield, and a band. The panel is flexible and can be wrapped around and detachably secured to a limb of a person. The panel includes an inner layer and an outer layer. Each of the inner layer and the outer layer includes woven para-aramid fibers resistant to heat and impact forces. The shield is between the inner and outer layers. The shield includes two side portions and a central portion projecting in a substantially convex manner away from the inner layer. The shield includes a thermoplastic vulcanizate polymer material resistant to heat and impact forces. The band is positioned between the shield and the inner layer. The band extends across the shield and is connected to the side portions with space between the band and the central portion. The band includes woven para-aramid fibers resistant to heat and impact forces.

19 Claims, 9 Drawing Sheets

PROTECTIVE BODY GEAR DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to protective body gear and more particularly pertains to a new protective body gear device for protecting portions of the body from damage due to impacts and heat. The protective body gear device includes layers of material that is resistant to heat and impact forces, as well as a shield positioned between the layers, which shield also is made of material that is resistant to heat and impact forces. The protective body gear has a low profile and is lightweight to permit wearing under clothing during activities relating to jobs, sports, or recreation.

(2) Description of Related Art Including Information Disclosed Under 37 CFR 1.97 and 1.98

The prior art relates to articles of protective body gear that are made of heavy materials, project substantially from the body to prevent wearing under clothing, and have limited impact resistance and heat resistance. The prior art, as best understood, does not disclose a protective body gear device that includes a panel, a shield, and a band connected to the shield to space the shield from the body of a person wearing the protective body gear, wherein the panel includes woven para-aramid fibers resistant to heat and impact forces, the shield includes a thermoplastic vulcanizate polymer material resistant to heat and impact forces, and the band includes woven para-aramid fibers resistant to heat and impact forces.

BRIEF SUMMARY OF THE SUMMARY

An embodiment of the disclosure meets the needs presented above in a protective body gear device generally comprising a panel, a shield, and a band. The panel is flexible and designed to be wrapped around and detachably secured to a portion of a limb of a person. The panel includes an inner layer and an outer layer. Each of the inner layer and the outer layer includes woven para-aramid fibers resistant to heat and impact forces. The shield is positioned between the inner layer and the outer layer. The shield includes two side portions and a central portion projecting in a substantially convex manner away from the inner layer. The shield includes a thermoplastic vulcanizate polymer material resistant to heat and impact forces. The band is positioned between the shield and the inner layer. The band extends across the shield and is connected to the side portions of the shield with space in between the band and the central portion of the shield. The band includes woven para-aramid fibers resistant to heat and impact forces.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1A:
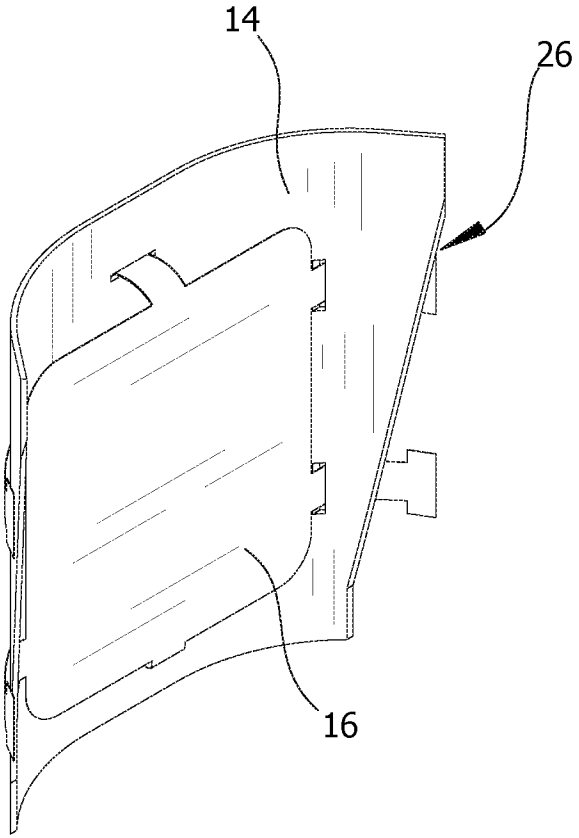
FIG. 1 is a perspective view of protective body gear devices according to embodiments of the disclosure.

With reference now to the drawings, and in particular to FIGS. 1 through 9 thereof, a new protective body gear device embodying the principles and concepts of an embodiment of the disclosure and generally designated by the reference numeral 10 will be described.

Figure 5:
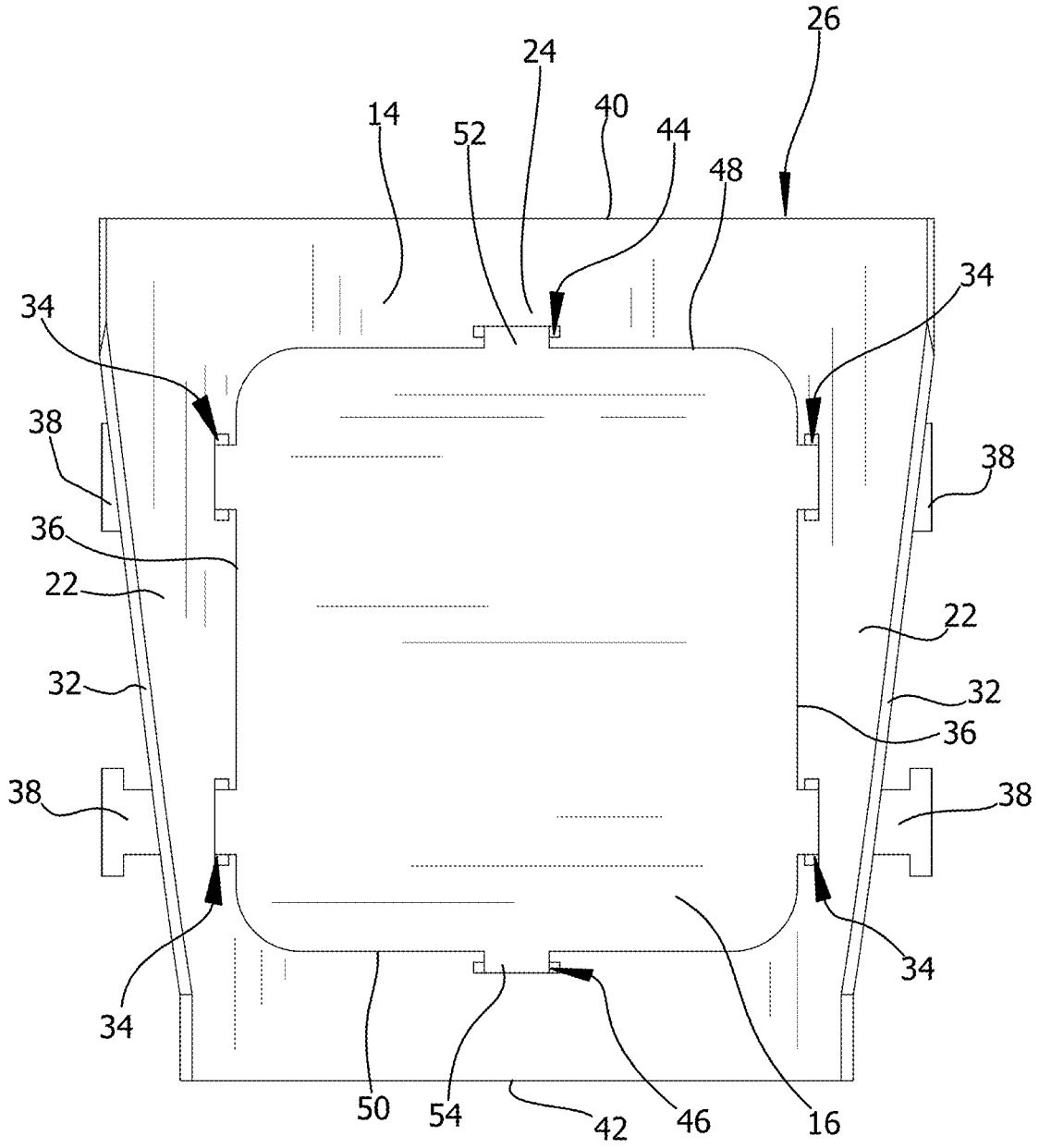
FIG. 5 is a rear view of an embodiment of the disclosure.
Figure 6:
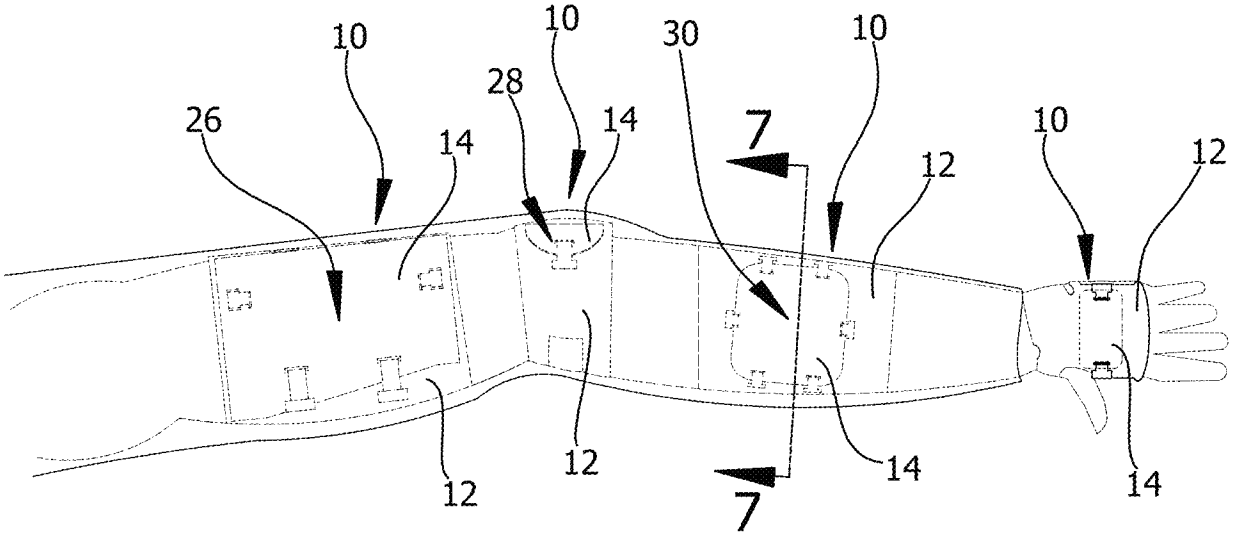
FIG. 6 is a side view of an embodiment of the disclosure in use.
Figure 7:
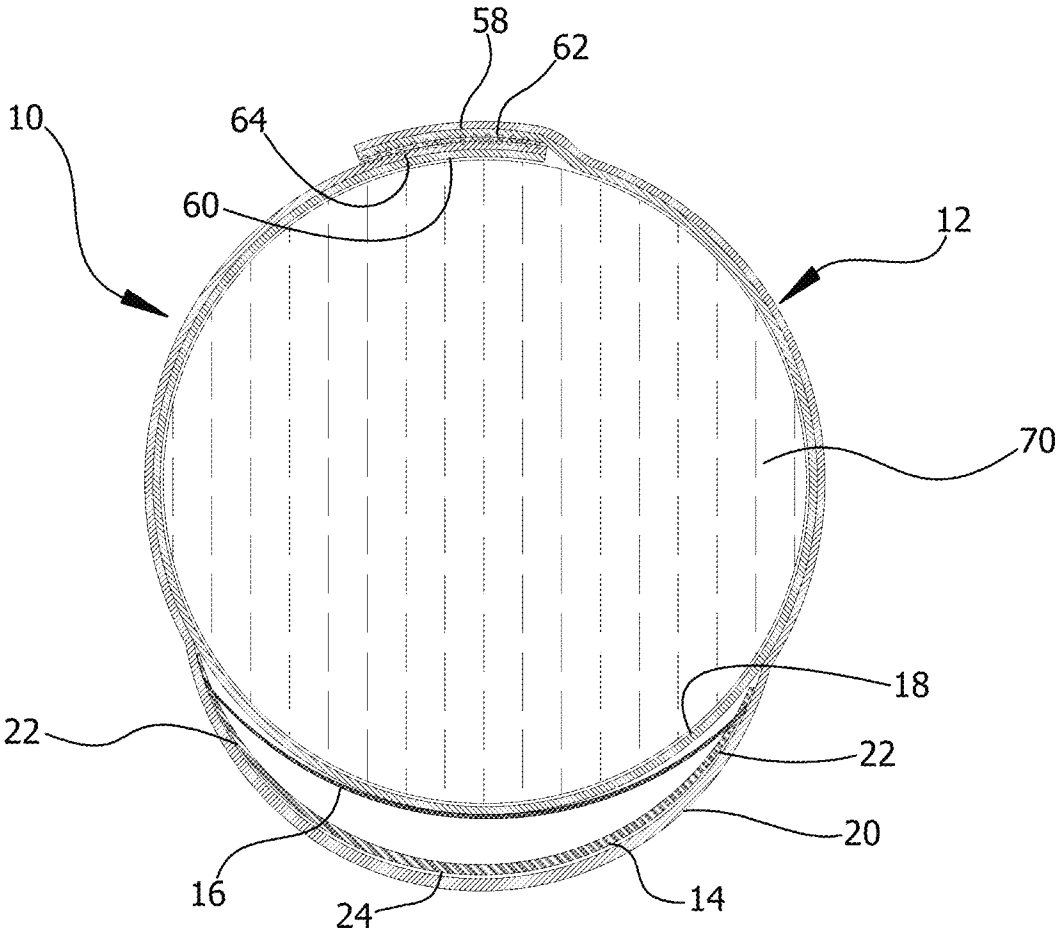
FIG. 7 is a cross-sectional view of an embodiment of the disclosure shown in FIG. 6.

As best illustrated in FIGS. 1 through 9, the protective body gear device 10 generally comprises a panel 12, a shield 14, and a band 16. As best shown in FIG. 7, the panel 12 is flexible and designed to be wrapped around and detachably secured to a portion of a limb 70 of a person. The panel 12 includes an inner layer 18 and an outer layer 20. Each of the inner layer 18 and the outer layer 20 includes woven para-aramid fibers resistant to heat and impact forces. The shield 14 is positioned between the inner layer 18 and the outer layer 20. The shield 14 includes two side portions 22 and a central portion 24 projecting in a substantially convex manner away from the inner layer 18. The shield 14 includes a thermoplastic vulcanizate polymer material resistant to heat and impact forces. The band 16 is positioned between the shield 14 and the inner layer 18. The band 16 extends across the shield 14 and is connected to the side portions 22 of the shield 14 with space in between the band 16 and the central portion 24 of the shield 14. The band 16 includes woven para-aramid fibers resistant to heat and impact forces.

Figure 1B:
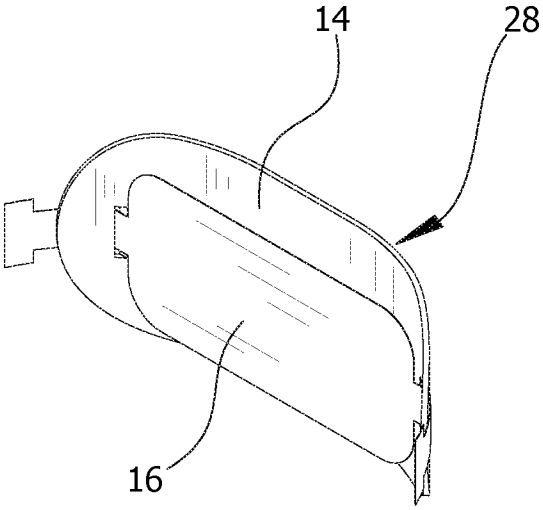
Figure 1C:
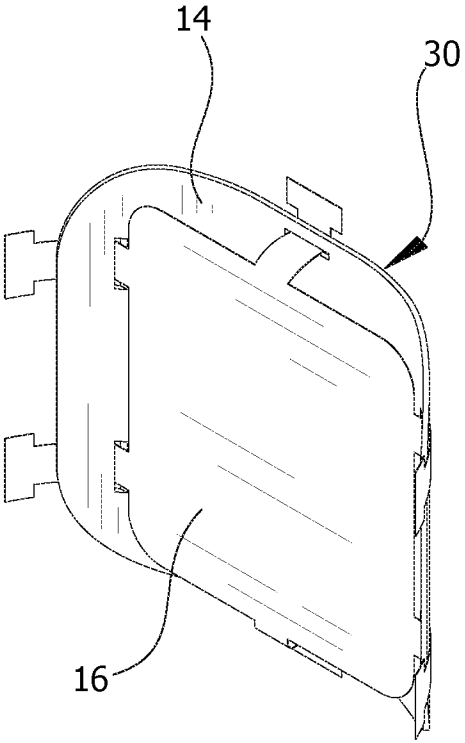

FIG. 1 shows three possible designs of the shield 14, though other shapes are within the scope of the disclosure. The first shield 26, also shown in FIG. 5, has a tapered or trapezoidal shape that could be suitable for protecting areas of the body that taper from wider to narrower portions, such as, for example, an upper arm or thigh of a person. The second shield 28, also shown in FIG. 2, has a rectangular shape with rounded corners and edges, though the corners could also be angular like the first shield 26. The second shield 28 could be suitable for protecting smaller areas of the body, such as, for example, hands, wrists, elbows, ankles, and knees. The third shield 30, also shown in FIG. 3, has an essentially square shape, also with rounded corners that could be angular as well. The third shield 30 could be suitable for somewhat larger areas of the body, such as forearms, shins, hips, and shoulders. It should be noted that the first shield 26, second shield 28, and third shield 30 are exemplary embodiments to illustrate possible designs of the shield 14, and other shapes, sizes, and configurations are within the scope of the disclosure. In addition, features that are common to different designs of the shield 14 are discussed herein with reference to the shield 14 in general, and any reference to "the shield" and components thereof should be considered as being applicable to at least one or more, or possibly all, of the exemplary embodiments shown in the figures, as well as designs not within the scope of the disclosure but not shown in the figures.

Figure 2:
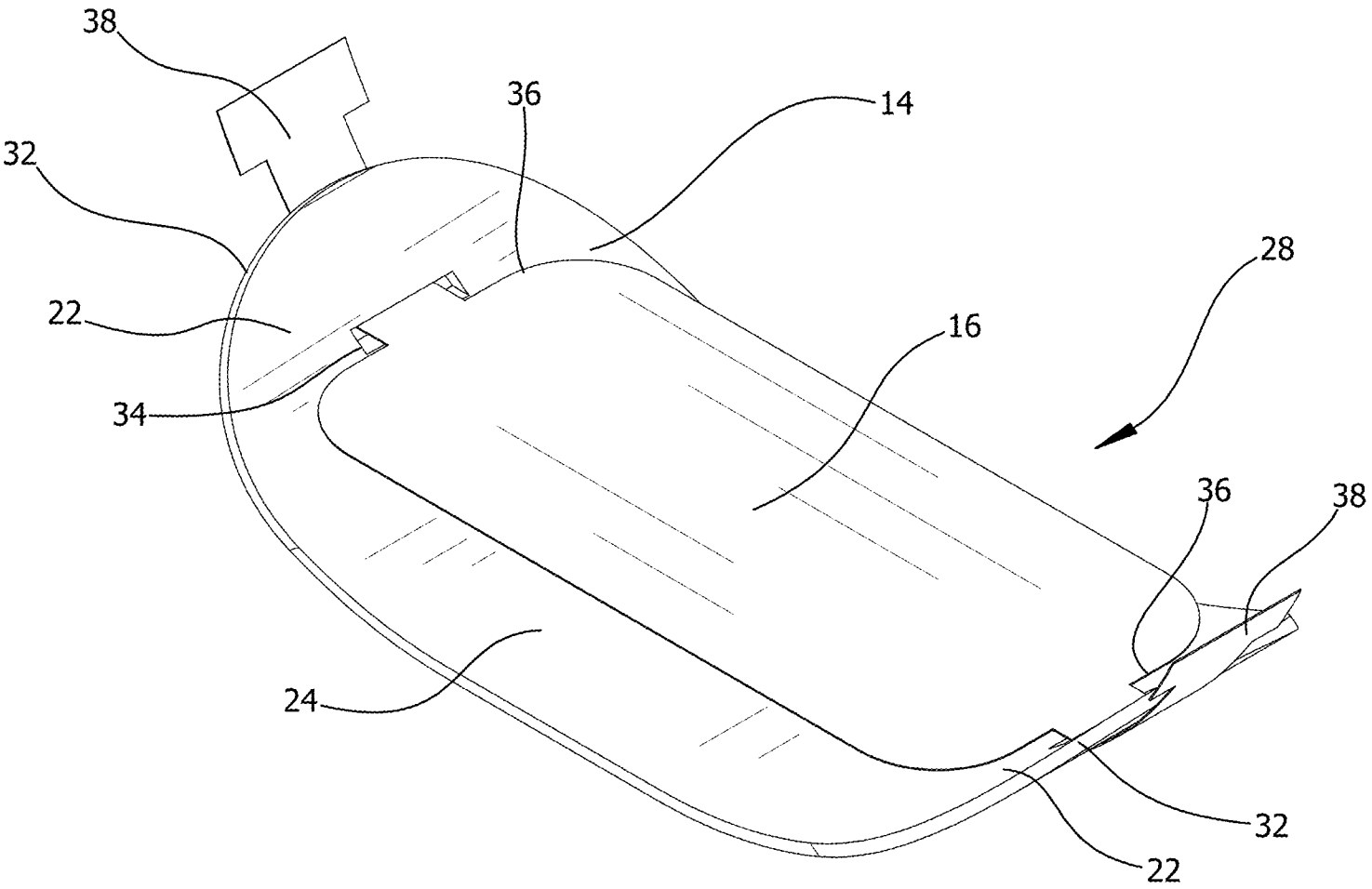
FIG. 2 is a rear perspective view of an embodiment of the disclosure.
Figure 3:
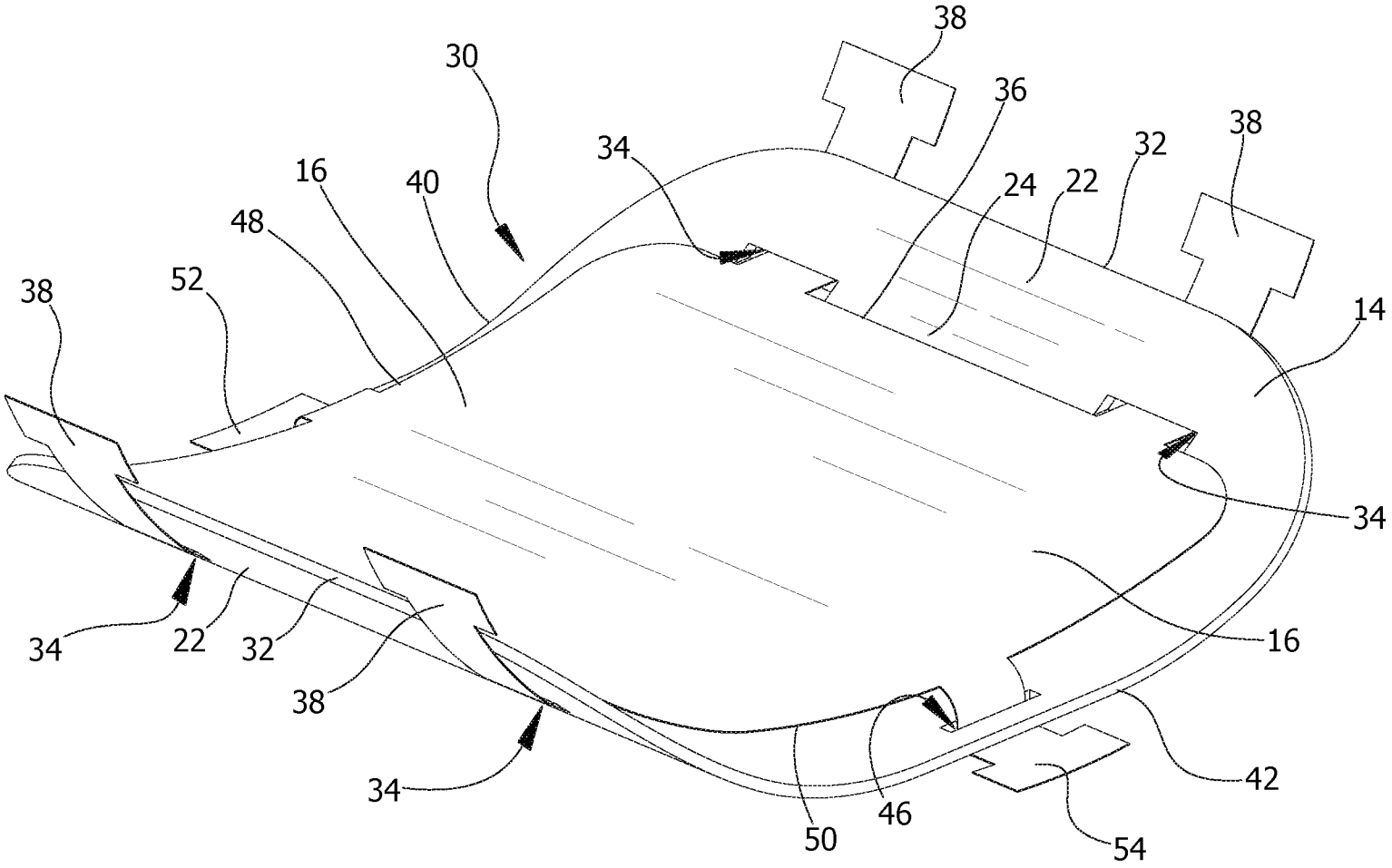
FIG. 3 is a rear perspective view of an embodiment of the disclosure.

With reference to the exemplary embodiment in FIG. 2, the shield 14 includes two side shield edges 32. Each of the side shield edges 32 is positioned at a respective one of the side portions 22 of the shield 14. The shield 14 includes two side slots 34. Each of the two side slots 34 is positioned in a respective one of the two side portions 22 adjacent a respective one of the side shield edges 32. The band 16 includes two side band edges 36. Each of the two side band edges 36 is positioned adjacent a respective one of the two side shield edges 32. The band 16 includes two side projections 38. Each of the two side projections 38 is attached to the outer layer 20 of the panel 12. Each of the two side projections 38 is positioned projecting through a respective one of the two side slots 34 to secure the shield 14 to the panel 12. In the exemplary embodiments shown in FIGS. 3 and 5, the band 16 is larger and includes four side projections 38 and the shield 14 includes four side slots 34. However, the band 16 and the shield 14 could be designed to have any number of side projections 38 and respective side slots 34.

With reference to the exemplary embodiment in FIG. 5, the shield 14 further includes a top shield edge 40 and a bottom shield edge 42 positioned at opposite ends of the central portion 24 of the shield 14 and transverse to the two side shield edges 32. The shield 14 includes a top slot 44 positioned in the central portion 24 adjacent the top shield edge 40, as well as a bottom slot 46 positioned in the central portion 24 adjacent the bottom shield edge 42. The band 16 includes a top band edge 48 and a bottom band edge 50. Each of the top band edge 48 and the bottom band edge 50 is positioned adjacent a respective one of the top shield edge 40 and the bottom shield edge 42. The band 16 includes a top projection 52 and a bottom projection 54. Each of the top projection 52 and the bottom projection 54 is attached to the outer layer 20 of the panel 12. Each of the top projection 52 and the bottom projection 54 is positioned projecting through a respective one of the top slot 44 and the bottom slot 46 to further secure the shield 14 to the panel 12. The band 16 could be designed to have any number of top projections 52 and bottom projections 54, and the shield 14 to have a respective number of top slots 44 and bottom slots 46. In one possible embodiment, the band 16 is attached to the panel 12 by stitching, though the band 16 could be attached by adhesive or other connecting means, such as snaps, buttons, and zippers.

Figure 9:
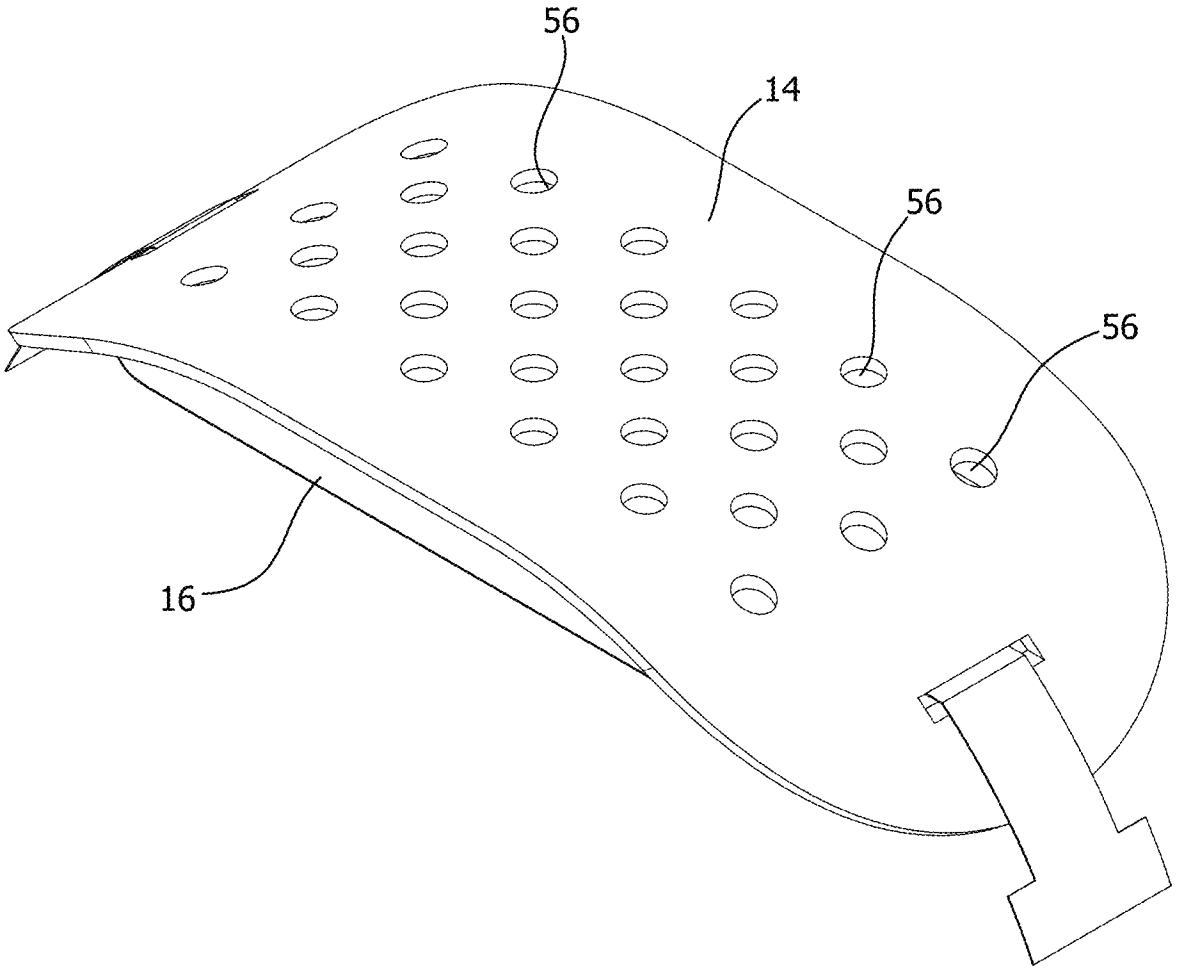
FIG. 9 is a front perspective view of an embodiment of the disclosure.

As shown in FIG. 9, in one possible embodiment of the shield 14 includes a plurality of orifices 56 to permit passage of air through the shield 14.

In one possible embodiment, the inner layer 18 includes soft and breathable material to promote comfortable placement against the skin of a limb 70. In one possible embodiment, each of the inner layer 18 and the outer layer 20 includes a blend of para-aramid fibers resistant to heat and impact forces and other synthetic or natural fibers, such as silica, carbon, and fiberglass, having heat-resistant properties, impact-resistant properties, or a combination thereof. In one possible embodiment, the band 16 includes a blend of para-aramid fibers resistant to heat and impact forces and other synthetic or natural fibers, such as silica, carbon, and fiberglass, having heat-resistant properties, impact-resistant properties, or a combination thereof. In another possible embodiment, the shield 14 includes thermoplastic vulcanizate polymer material resistant to heat and impact forces and other synthetic or natural materials and polymers, such as polycarbonate, high-density polyethylene (HDPE), acrylonitrile butadiene styrene (ABS), high impact polystyrene, polyamide-imide (PAI), polyetherimide (PEI), polyether ether ketone (PEEK), polydicyclopentadiene (pDCPD), and polytetrafluoroethylene (PTFE), having heat-resistant properties, impact-resistant properties, or a combination thereof.

Figure 4B:
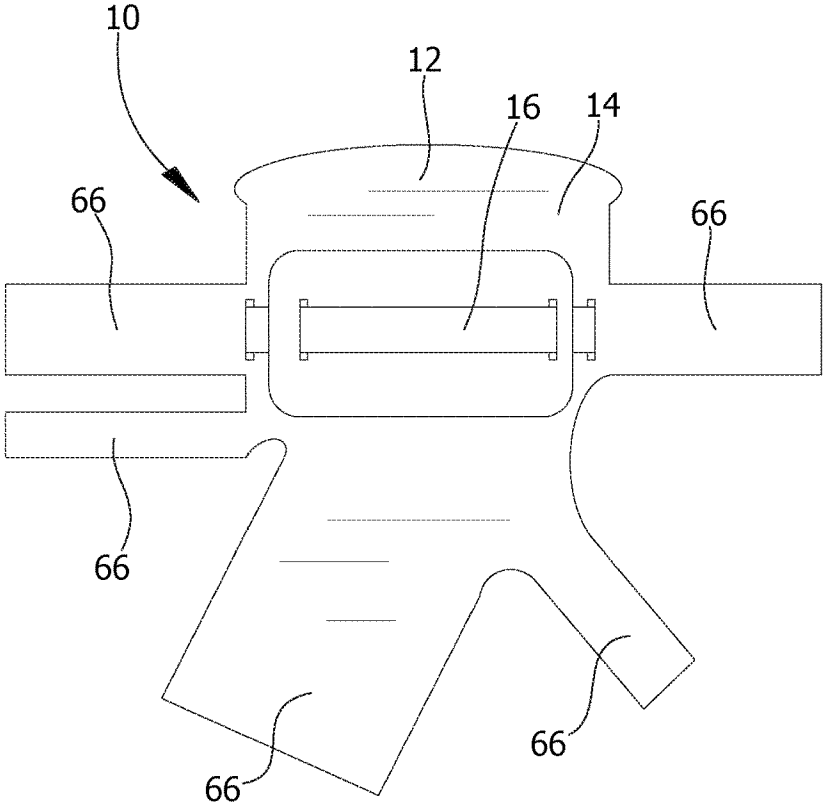
FIG. 4 is a front view of an embodiment of the disclosure.
Figure 4A:
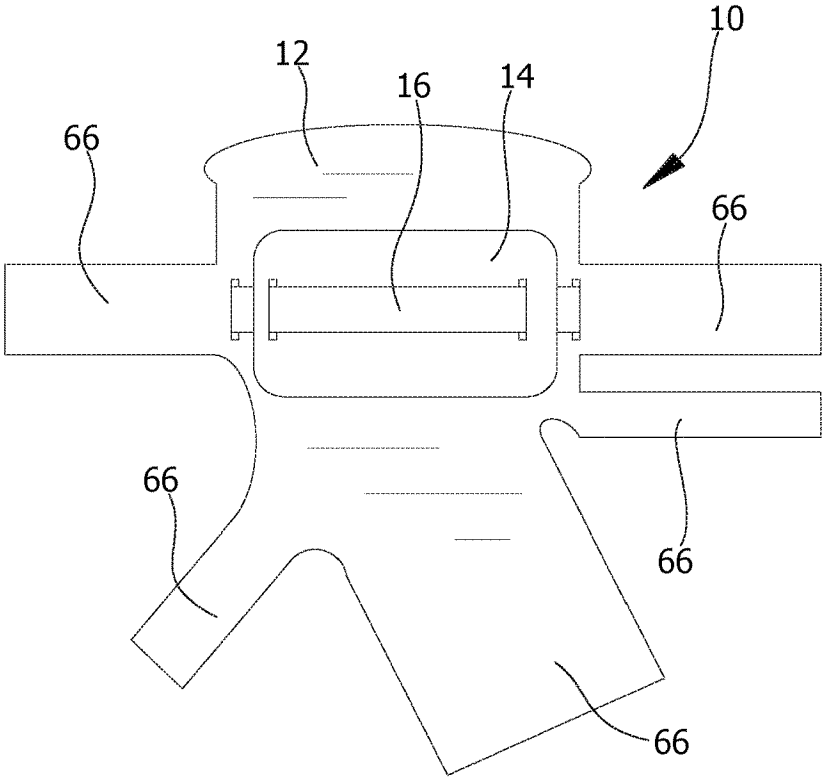

FIGS. 4, 6, 7, and 8 show possible designs of the panel 12 for attachment to the body of a person, such as a limb 70 of a person, in this case an arm. FIG. 7 shows a cross-section of the protective body gear device 10 that includes the third shield 30 wrapped around a forearm of a person. The panel 12 includes a first end 58 and a second end 60 detachably connected to the first end 58. The first end 58 includes loop material 62 and the second end 60 includes hook material 64 designed to detachably connect to the loop material 62. The resulting shape of the panel 12 is essentially a tube that conforms to the forearm. Other detachable connections, such as buttons, snaps, zippers, and clasps are within the scope of the disclosure. FIG. 4 shows a design of the panel 12 with straps 66 for wrapping around a hand of a person. FIG. 6 shows the first shield 26 protecting an upper arm, the second shield 28 protecting an elbow, and the third shield 30 protecting a forearm. The hand version of the protective body gear device 10 shown in FIG. 4 is connected to a hand. Each of the shields 14 is connected to the arm using its respective panel 12 wrapped around the arm. Each of the panels 12 could be designed in a manner suitable for fitting onto a particular portion of the arm, as is well known in the protective gear technology. While the exemplary embodiment is shown being used on an arm of a person, the protective body gear device 10 can also be adapted for use on a leg of a person. In one possible embodiment, the protective body gear device 10 could be adapted for use to protect any area of the body, including arms and hands, legs and feet, torso including chest and pelvic areas, and the neck and head.

Figure 8:
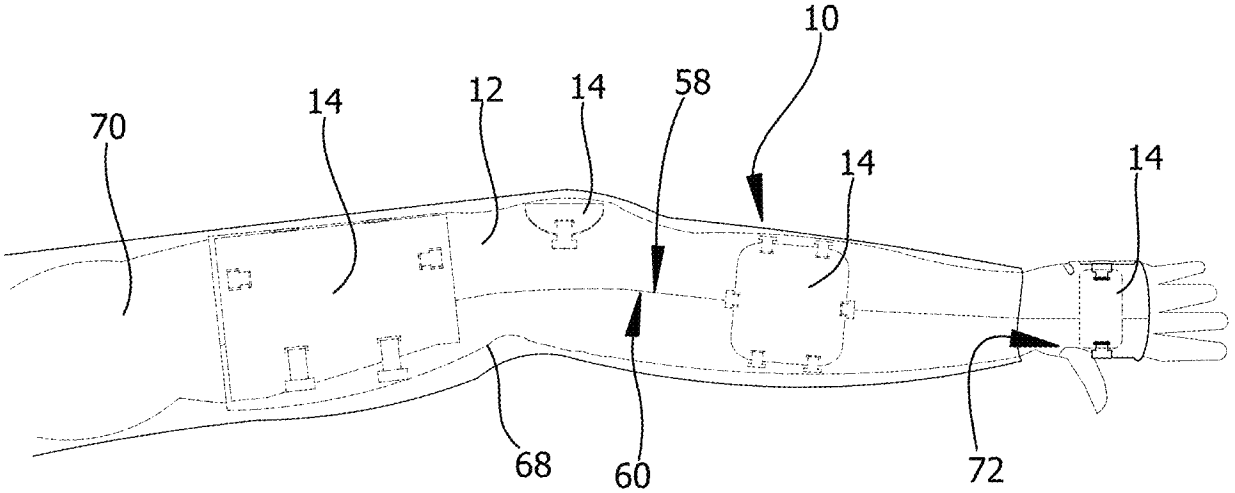
FIG. 8 is a side view of another embodiment of the disclosure.

FIG. 8 shows an alternative design in which the panel 12 includes a first end 58 and a second end 60 affixed to the first end 58 to form a sleeve 68 designed to be slid onto a limb 70 of a person. The protective body gear device 10 further includes a plurality of the shields 14 and a plurality of the bands 16. Each of the shields 14 is connected to the sleeve 68 by a respective one of the bands 16. At least two of the plurality of the shields 14 have a different shape designed to protect a respective portion of a limb 70 of a person. In the exemplary embodiment shown, four different shields 14 are attached to the sleeve 68, and the sleeve 68 includes a thumb hole 72 to help further secure the sleeve 68 to the arm. The sleeve 68 may include resilient elastic material. In another possible embodiment, the sleeve 68 includes sections of woven para-aramid fibers resistant to heat and impact forces, which are generally resistant to stretching, and sections of resilient elastic material, such as neoprene.

In one possible embodiment, the panel 12 could include reflective material, such as glass beads distributed throughout or reflective strips, for enhanced safety and visibility in low light conditions.

In use, the protective body gear device 10 protects the adjacent body part from injuries due to impacts and heat. The heat resistance of the components of the body gear device prevents heat from heating and damaging the adjacent body part. The impact resistance of the components of the body gear device dissipates most any impact forces from contacting and damaging the adjacent body part. In addition, the design of the shield 14 and band 16 further dissipates impact forces. As best seen in FIG. 7, the shield 14 is spaced from the band 16 to essentially act as a cushion and primary recipient of impact forces. The band 16, by virtue of its connection at the edges of the shield 14, helps transfer impact forces outwardly. Ideally, most, if not all, of the forces from an impact will be absorbed and dissipated by the outer layer 20, the shield 14, and the band 16 without substantially any of the forces impacting the inner layer 18. However, the inner layer 18 is also impact-resistant, so the inner layer 18 functions as a last line of defense against impact forces, though such forces would be minimal due to the effects of the outer layer 20, the shield 14, and the band 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A protective body gear device comprising:

a panel being flexible and configured to be wrapped around and detachably secured to a portion of a limb of a person, said panel including an inner layer and an outer layer, each of said inner layer and said outer layer including woven para-aramid fibers being resistant to heat and impact forces;

a shield being disposed between said inner layer and said outer layer, said shield including two side portions and a central portion projecting in a substantially convex manner away from said inner layer, said shield including a thermoplastic vulcanizate polymer material being resistant to heat and impact forces; and a band being disposed between said shield and said inner layer, said band extending across said shield and being connected to said side portions of said shield with a space in between said band and said central portion of said shield, said space extending over a majority of a width of said band and over a majority of a width of said central portion of said shield, said band including woven para-aramid fibers being resistant to heat and impact forces.

2. The protective body gear device of claim 1, wherein:

said shield includes two side shield edges, each of said side shield edges is disposed at a respective one of said side portions of said shield;

said shield includes two side slots, each of said two side slots is disposed in a respective one of said two side portions adjacent a respective one of said side shield edges;

said band includes two side band edges, each of said two side band edges is disposed adjacent a respective one of said two side shield edges; and said band includes two side projections, each of said two side projections is attached to said outer layer of said panel, each of said two side projections is disposed projecting through a respective one of said two side slots to secure said shield to said panel.

3. The protective body gear device of claim 2, wherein:

said shield includes a top shield edge and a bottom shield edge disposed at opposite ends of said central portion of said shield and transverse to said two side shield edges;

said shield includes a top slot disposed in said central portion adjacent said top shield edge, and a bottom slot disposed in said central portion adjacent said bottom shield edge;

said band includes a top band edge and a bottom band edge, each of said top band edge and said bottom band edge is disposed adjacent a respective one of said top shield edge and said bottom shield edge; and said band includes a top projection and a bottom projection, each of said top projection and said bottom projection is attached to said outer layer of said panel, each of said top projection and said bottom projection is disposed projecting through a respective one of said top slot and said bottom slot to further secure said shield to said panel.

4. The protective body gear device of claim 1, wherein said shield includes a plurality of orifices to permit passage of air through said shield.

5. The protective body gear device of claim 1, wherein said inner layer includes soft and breathable material to promote comfortable placement against the skin of the limb.

6. The protective body gear device of claim 1, wherein said panel includes a first end and a second end, said second end detachably connected to said first end.

7. The protective body gear device of claim 6, wherein said first end includes loop material and said second end includes hook material configured to detachably connect to said loop material.

8. The protective body gear device of claim 1, wherein said panel includes a first end and a second end, said second end affixed to said first end to form a sleeve configured to be slid onto the limb of the person.

9. The protective body gear device of claim 8, wherein the protective body gear device further comprises a plurality of said shields and a plurality of said bands, each of said shields is connected to said sleeve by a respective one of said bands, at least two of said plurality of said shields have a different shape configured to protect a respective portion of the limb of the person.

10. A protective body gear device comprising:

a panel being flexible and configured to be wrapped around and detachably secured to a portion of a limb of a person, said panel including an inner layer and an outer layer, each of said inner layer and said outer layer including woven para-aramid fibers being resistant to heat and impact forces, wherein:

said inner layer includes soft and breathable material to promote comfortable placement against the skin of the limb;

a shield being disposed between said inner layer and said outer layer, said shield including two side portions and a central portion projecting in a substantially convex manner away from said inner layer, said shield including a thermoplastic vulcanizate polymer material being resistant to heat and impact forces, wherein:

said shield includes two side shield edges, each of said side shield edges is disposed at a respective one of said side portions of said shield;

said shield includes two side slots, each of said two side slots is disposed in a respective one of said two side portions adjacent a respective one of said side shield edges;

said shield includes a plurality of orifices to permit passage of air through said shield; and a band being disposed between said shield and said inner layer, said band extending across said shield and being connected to said side portions of said shield with a space in between said band and said central portion of said shield, said space extending over a majority of a width of said band and over a majority of a width of said central portion of said shield, said band including woven para-aramid fibers being resistant to heat and impact forces, wherein:

said band includes two side band edges, each of said two side band edges is disposed adjacent a respective one of said two side shield edges;

said band includes two side projections, each of said two side projections is attached to said outer layer of said panel, each of said two side projections is disposed projecting through a respective one of said two side slots to secure said shield to said panel.

11. The protective body gear device of claim 10, wherein:

said shield includes a top shield edge and a bottom shield edge disposed at opposite ends of said central portion of said shield and transverse to said two side shield edges;

said shield includes a top slot disposed in said central portion adjacent said top shield edge, and a bottom slot disposed in said central portion adjacent said bottom shield edge;

said band includes a top band edge and a bottom band edge, each of said top band edge and said bottom band edge is disposed adjacent a respective one of said top shield edge and said bottom shield edge; and said band includes a top projection and a bottom projection, each of said top projection and said bottom projection is attached to said outer layer of said panel, each of said top projection and said bottom projection is disposed projecting through a respective one of said top slot and said bottom slot to further secure said shield to said panel.

12. The protective body gear device of claim 11, wherein said panel includes a first end and a second end, said second end affixed to said first end to form a sleeve configured to be slid onto the limb of the person.

13. The protective body gear device of claim 12, wherein the protective body gear device further comprises a plurality of said shields and a plurality of said bands, each of said shields is connected to said sleeve by a respective one of said bands, at least two of said plurality of said shields have a different shape configured to protect a respective portion of the limb of the person.

14. The protective body gear device of claim 10, wherein said panel includes a first end and a second end, said second end detachably connected to said first end.

15. The protective body gear device of claim 14, wherein said first end includes loop material and said second end includes hook material configured to detachably connect to said loop material.

16. The protective body gear device of claim 10, wherein said panel includes a first end and a second end, said second end affixed to said first end to form a sleeve configured to be slid onto the limb of the person.

17. The protective body gear device of claim 16, wherein the protective body gear device further comprises a plurality of said shields and a plurality of said bands, each of said shields is connected to said sleeve by a respective one of said bands, at least two of said plurality of said shields have a different shape configured to protect a respective portion of the limb of the person.

18. The protective body gear device of claim 11, wherein said panel includes a first end and a second end, said second end detachably connected to said first end.

19. The protective body gear device of claim 18, wherein said first end includes loop material and said second end includes hook material configured to detachably connect to said loop material.

* * * * *